US007394449B2

(12) United States Patent
Moon

(10) Patent No.: US 7,394,449 B2
(45) Date of Patent: Jul. 1, 2008

(54) BACK-LIGHT APPARATUS FOR LIQUID CRYSTAL DISPLAY DEVICE

(75) Inventor: Jeong-Min Moon, Gyeonggi-Do (KR)

(73) Assignee: LG. Display Co., Ltd., Seoul (KR)

( * ) Notice: Subject to any disclaimer, the term of this patent is extended or adjusted under 35 U.S.C. 154(b) by 631 days.

(21) Appl. No.: 10/964,042

(22) Filed: Oct. 14, 2004

(65) Prior Publication Data

US 2005/0151889 A1 Jul. 14, 2005

(30) Foreign Application Priority Data

Dec. 29, 2003 (KR) ..... 10-2003-0099386

(51) Int. Cl.
*G09G 3/36* (2006.01)

(52) U.S. Cl. ..... 345/102; 345/84

(58) Field of Classification Search ..... 345/76–102
See application file for complete search history.

(56) References Cited

U.S. PATENT DOCUMENTS 6,160,596 A * 12/2000 Sylvester et al. ..... 349/61
6,841,947 B2 * 1/2005 Berg-johansen ..... 315/169.3
6,873,262 B2 * 3/2005 Midlang ..... 340/585
6,891,525 B2 * 5/2005 Ogoro ..... 345/102
7,002,546 B1 * 2/2006 Stuppi et al. ..... 345/102

* cited by examiner

*Primary Examiner*—Bipin Shalwala
*Assistant Examiner*—Jean Lesperance
(74) *Attorney, Agent, or Firm*—McKenna Long & Aldridge LLP

(57) ABSTRACT

A back-light apparatus for a display includes: a plurality of light emitting diodes attached on a substrate; a first common line mounted on the substrate to commonly connect first electrodes of the light emitting diodes; a second common line mounted on the substrate to commonly connect second electrodes of the light emitting diodes; a plurality of third lines connected to preceding second electrodes of the light emitting diodes and succeeding first electrodes of the light emitting diodes; first and second selection switches disconnecting the first common line and the second common line so that the light emitting diodes are connected in parallel; third selection switches for disconnecting the third lines so that the light emitting diodes are connected in series; a power unit to supply power to the light emitting diodes; and a control unit to control the first, second and third selection switches for the light emitting diodes.

28 Claims, 7 Drawing Sheets

BACK-LIGHT APPARATUS FOR LIQUID CRYSTAL DISPLAY DEVICE

This application claims benefit of Korean Application Number 99386/2003, filed Dec. 29, 2003, which is hereby incorporated by a reference for all purposes as if fully set forth herein.

BACKGROUND OF THE INVENTION

1. Field of the Invention

The present invention relates to a back-light apparatus for a liquid crystal display device. More particularly, the present invention relates to a back-light apparatus for a liquid crystal display device that supplies light to a liquid crystal display panel through a plurality of light emitting diodes (LED).

2. Discussion of the Related Art

A liquid crystal display (LCD) is a display apparatus in which data signals, including image information, are individually supplied to pixels arranged in a matrix, and optical transmittance of the pixels is controlled to display a desired image. Accordingly, the LCD includes a display panel in which pixels are arranged in a matrix and a driving part for driving the pixels.

The display panel includes a thin film transistor array and a color filter substrate which are attached together to face each other with a certain cell-gap therebetween and a liquid crystal layer formed between the attached color filter substrate and thin film transistor array substrate.

A common electrode and a pixel electrode are formed in an LCD panel formed by attaching the thin film transistor array substrate and the color filter substrate together and applying an electric field to the liquid crystal layer.

If voltage of a data signal is applied to the pixel electrode and the common electrode, liquid crystal of the liquid crystal layer is rotated by its dielectric anisotropy according to an electric field between the common electrode and the pixel electrode. Accordingly, light is transmitted or cut off pixel by pixel so that text or an image is displayed.

Additionally, the LCD cannot emit light by itself and displays an image by controlling the optical transmittance. For this reason, the LCD requires a special apparatus for radiating light to a display panel, that is, a back-light apparatus.

The back-light apparatus is divided into a side type and a direct type. As for the side type back-light apparatus, a lamp is located at one or both sides of a display panel, and light is reflected, diffused and concentrated through a light guide, a reflector and optical sheets. With regard to the direct type back-light, a lamp is located at a back surface of the display panel so that light is directly transmitted to the entire surface of the display panel.

The side type back-light apparatus and direct type back-light apparatus will be described in detail with reference to FIGS. 1 and 2.

FIG. 1 is an exemplary view showing a general side-type back-light apparatus.

FIG. 2 is an exemplary view showing a general direct-type back-light apparatus.

FIG. 3 is an exemplary view showing a lamp which is used in the general side-type back-light apparatus or in the general direct-type back-light apparatus, in detail.

In FIG. 1, the general side type back-light apparatus includes a light guide 110 located on a back surface of a display panel; a lamp 120 located at a side of the light guide 110; a reflector 130 located at a back surface of the light guide 110; a lamp holder and a lamp reflector 121 fixing the lamp to the side of the light guide 110; and a line 122 for supplying power to the lamp 120.

Light generated from the lamp 120 is incident upon a side of the light guide 110 made of a transparent material. The reflector 130 located at the back surface of the light guide 110 reflects light that is transmitted to the back surface of the light guide 110 to an upper surface of the light guide 110, thereby reducing light loss and improving uniformity. Accordingly, together with the reflector 130, the light guide 110 transmits light that is generated from the lamp 120 to the upper surface.

In FIG. 2, the direct-type back-light apparatus includes a reflector 230 located at a back surface of a display panel; a plurality of lamps 220 disposed on the reflector 230 and producing light incident upon an entire back surface of the display panel; a diffusion plate 250 covering the lamps 220 and diffusing light generated from the lamps 220; and lines 220 supplying power to the lamps 220.

In FIG. 3, a cold cathode fluorescence lamp (CCFL) having a tube shape with a length corresponding to a distance between the long sides or short sides of the display panel is used as the lamp 120, 220 for the side-type back-light apparatus or the direct-type back-light apparatus. The CCFL generates white light by power supplied through the lines 122, 221 positioned.

Because mercury used as a fluorescent material in the CCFL is harmful to a human body, the CCFL does not meet stricter environmental regulations.

Additionally, in order to improve transmittance and a color reappearing rate of an LCD, an LCD using a time-division method has been actively developed. In the time-division method, one frame of an image is time-divided into first to third sub frames, and red, green and blue light is sequentially supplied according to the first to third sub-frames. However, a back-light apparatus using the CCFL is restricted in its useful range for an LCD adopting the time-division method.

SUMMARY OF THE INVENTION

Accordingly, the present invention is directed to a back-light apparatus for a liquid crystal display device that substantially obviates one or more problems due to limitations and disadvantages of the related art.

An advantage of the present invention is to provide a back-light apparatus for an LCD device capable of supplying light to a display panel using a plurality of light emitting diodes which can be used in an LCD adopting a time-division method without problems related to environment regulations of a cold cathode fluorescence lamp.

Another advantage of the present invention is to provide a back-light apparatus for an LCD device in which a plurality of light emitting diodes are arranged in an array, and electrical connection between the light emitting diodes may be selective.

Another advantage of the present invention is to provide a back-light apparatus for an LCD device which is equally suitable for use with various models of an LCD device without having to individually manufacture a light emitting unit, and can meet with various driving conditions of the LCD device to improve productivity.

Another object of the present invention is to provide a back-light apparatus for an LCD device in which light generated from light emitting chips is used with improved efficiency as one optical lens may be used to correspond to a plurality light emitting chips arranged in an array.

To achieve these and other advantages and in accordance with the purpose of the present invention, as embodied and broadly described herein, a back light apparatus for an LCD device includes: a light emitting unit including a plurality of light emitting diodes arranged on a substrate; a power unit to supply power to the light emitting diodes of the light emitting unit; and a control unit to control connection between the light emitting diodes of the light emitting unit.

In another embodiment of the present invention, a back-light apparatus for an LCD device includes: a plurality of light emitting diodes attached on a substrate; a first common line mounted on the substrate to commonly connect first electrodes of the light emitting diodes; a second common line mounted on the substrate to commonly connect second electrodes of the light emitting diodes; a plurality of third lines preceding second electrodes of the light emitting diodes and succeeding first electrodes of the light emitting diodes; first selection switches and second selection switches disconnecting the first common line and the second common line so that the light emitting diodes are connected in parallel; third selection switches disconnecting the third lines so that the light emitting diodes are connected in series; a power unit arranged to supply power to the light emitting diodes; and a control unit to control the first, second and third selection switches for the light emitting diodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings.

Figures 1, 2:
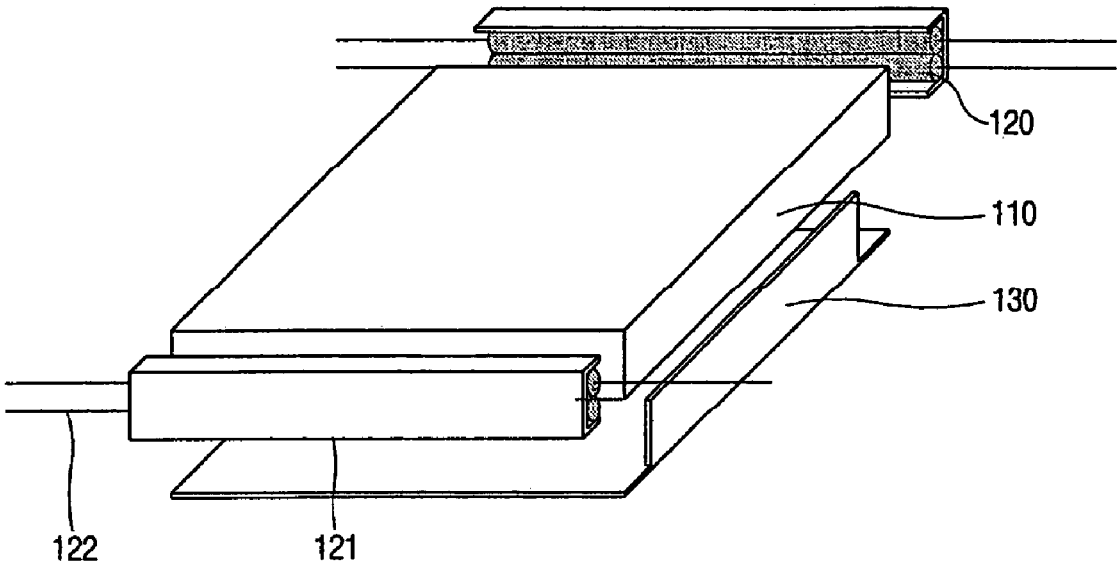
FIG. 1 RELATED ART
FIG. 2 RELATED ART
FIG. 1 is an exemplary view showing a generic side-type back-light apparatus.
FIG. 2 is an exemplary view showing a generic direct-type back-light apparatus.
Figure 3:
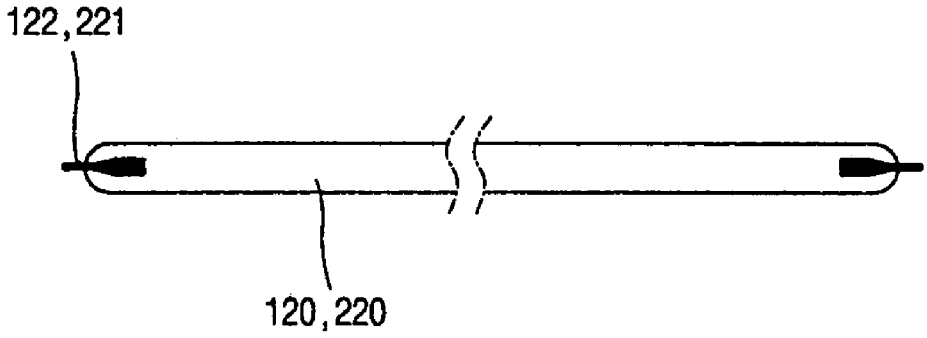
FIG. 3 RELATED ART
FIG. 3 is an exemplary view showing a lamp used in a generic side-type back-light apparatus or in a direct type back-light apparatus.
Figure 4:
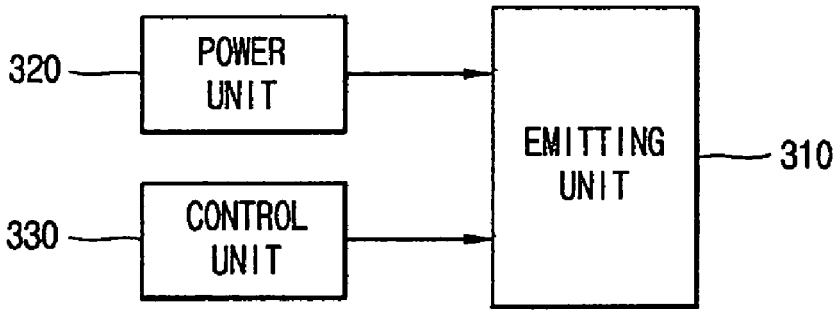
FIG. 4 is an exemplary view showing a block construction for a back-light apparatus for a liquid crystal display device in accordance with the present invention.
Figure 5:
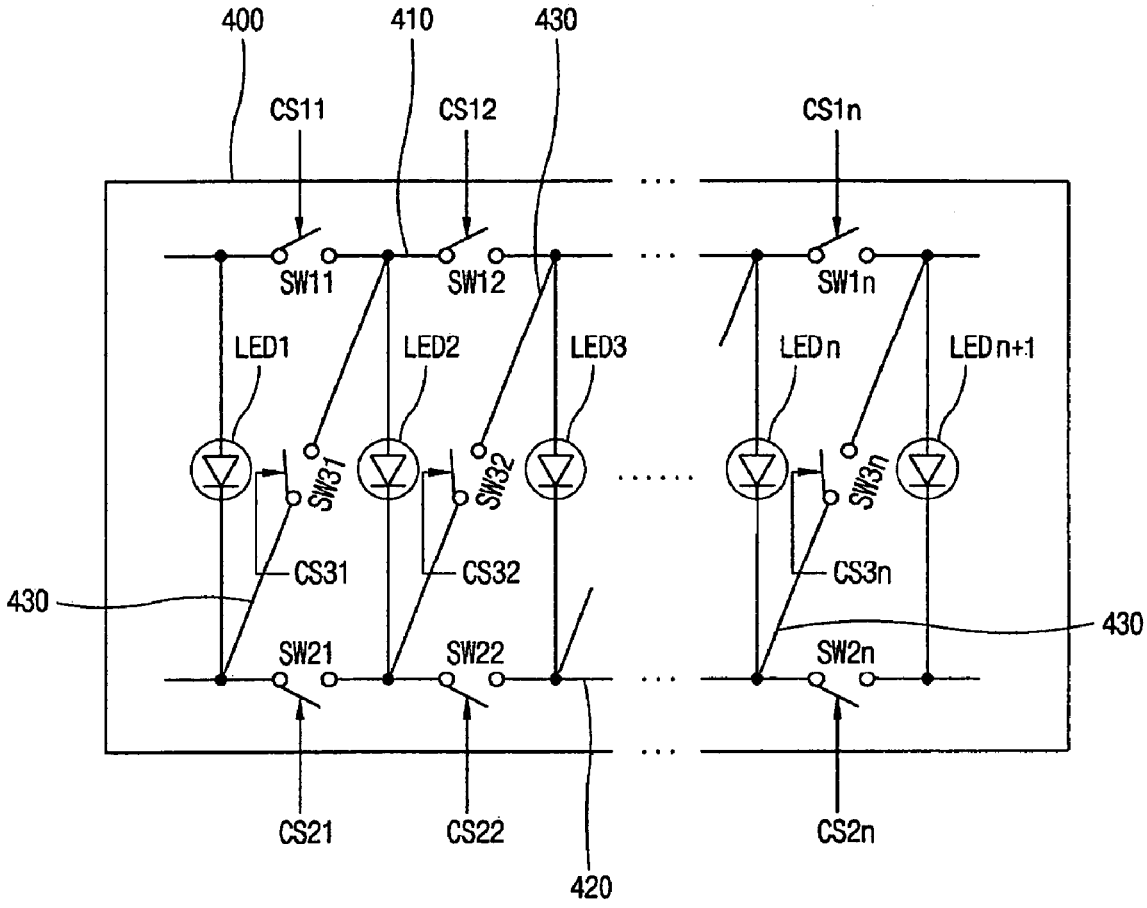
FIG. 5 is an exemplary view of light emitting diodes, arranged in an array form, of a light emitting unit, in FIG. 4.

FIG. 4 is an exemplary view showing a block construction for a back-light apparatus; and FIG. 5 is an exemplary view showing light emitting diodes arranged in an array, of a light emitting unit in FIG. 4.

In FIG. 4, a back-light apparatus for a liquid crystal display (LCD) device according to the present invention includes a light emitting unit 310 including a plurality of light emitting diodes arranged in an array, a power unit 320 for driving the light emitting diodes by supplying power to the light emitting diodes of the light emitting unit 310 and a control unit 330 for controlling connection between the light emitting diodes of the light-emitting unit 310.

As shown in FIG. 5, the plurality of light emitting diodes (LED1~LEDn+1) are attached on a substrate 400, and separated from each other at regular intervals to form an array.

First electrodes (e.g., anode electrodes) of the light emitting diodes (LED1~LEDn+1) are commonly connected to a first common line 410, and second electrodes (e.g., cathode electrodes) of the light emitting diodes are commonly connected to a second common line 420.

Preceding second electrodes and succeeding first electrodes of the light emitting diodes (LED1~LEDn+1) are connected to a plurality of third lines 430, respectively.

In addition, the first and second common lines 410 and 420 are entirely or locally disconnected or short-circuited by the first and second selection switches (SW11~SW1*n*, and SW21~SW2*n*), so that the light emitting diodes (LED1~LEDn+1) are entirely or locally connected in parallel.

The third lines 430 are entirely or locally disconnected or short-circuited by third selection switches (SW31~SW3*n*) so that the light emitting diodes (LED1~LEDn+1) are entirely or locally connected in series.

As for the back-light apparatus for an LCD device according to the present invention, a plurality of light emitting diodes (LED1~LEDn+1) may be attached on a substrate in an array, and their first electrodes and second electrodes are commonly connected to the first common line 410 and the second common line 420, respectively. Accordingly, the plurality of light emitting-diodes (LED1~LEDn+1) may be entirely or locally connected in parallel through the first and second selection switches (SW11~SW1*n*, and SW21~SW2*n*).

Additionally, the plurality of light emitting diodes (LED1~LEDn+1) are attached on the substrate 400 in an array, and their preceding second electrodes and succeeding first electrodes are connected to the third lines 430, respectively. Accordingly, the plurality of light emitting diodes (LED1~LEDn+1) may be entirely or locally connected in series through the third selection switches (SW31~SW3*n*).

Accordingly, the first to third selection switches (SW11~SW1*n*, SW21~SW2*n*, SW31~SW3*n*) are controlled to be turned ON or OFF according to a model of an LCD device or its driving condition so that the light emitting diodes (LED1~LEDn+1) can be entirely or locally connected in parallel or in series. As a result of such control, the back-light apparatus according to the present invention can effectively operate in a situation that requires light emitting diodes (LED1~LEDn+1) to be entirely or locally connected in parallel and a situation that requires the light emitting diodes (LED1~LEDn+1) to be entirely or locally connected in series without having to re-arrange the light emitting diodes (LED1~LEDn+1) on the substrate 400.

The first to third selection switches (SW11~SW1*n*, SW21~SW2*n*, SW31~SW3*n*) may be controlled to be turned ON or OFF so that some light emitting diodes (LED1~LEDn+1) are connected in parallel and the others are connected in series.

Figure 6:
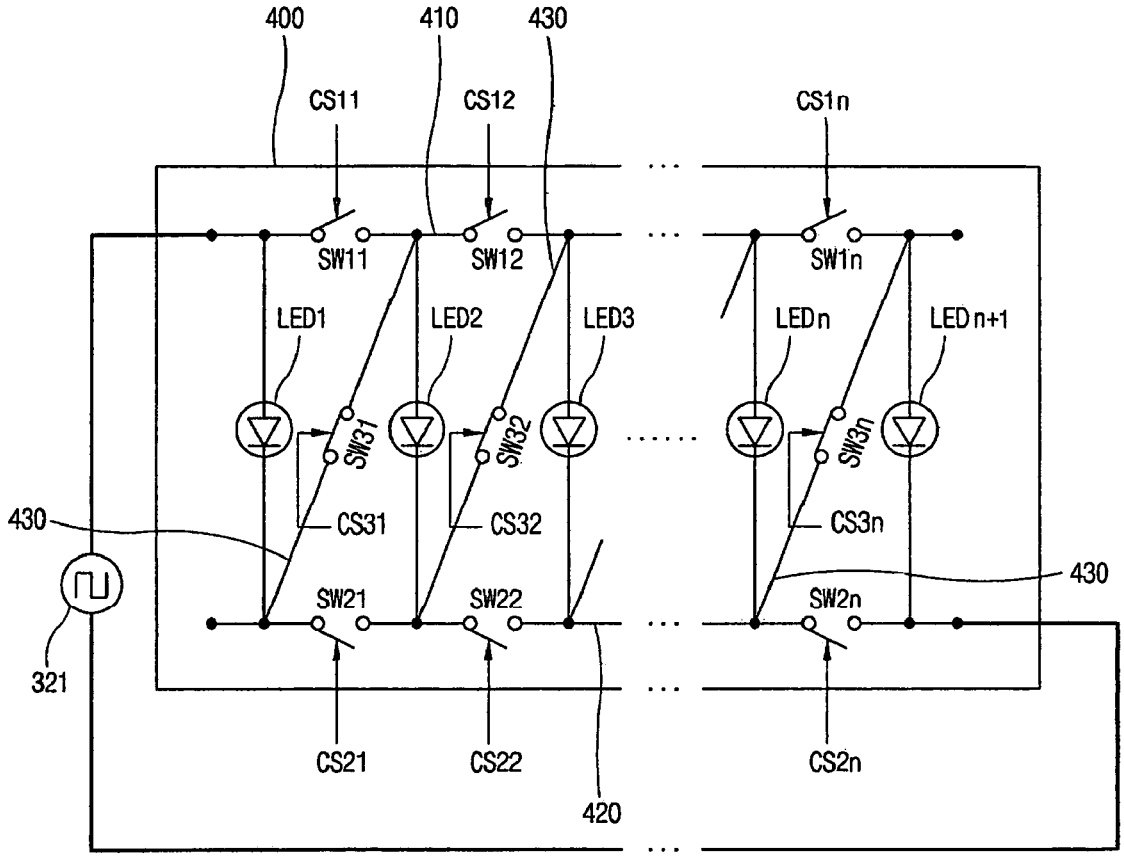
FIG. 6 is an exemplary view of a first embodiment of light emitting diodes connected in series according to turn-ON and turn-OFF of first to third selection switches in FIG. 5.

FIG. 6 is an exemplary view showing a first embodiment of light emitting diodes connected in series according to turn-ON and turn-OFF of the first to third selection switches.

In FIG. 6, the first and second selection switches (SW11~SW1*n* and SW21~SW2*n*) are turned OFF so that the first electrodes and the second electrodes of the light emitting diodes (LED1~LEDn+1) are not commonly connected to the first common line 410 and the second common line 420. But, the third selection switches (SW31~SW3*n*) are turned ON so that preceding second electrodes of the light emitting diodes (LED1~LEDn+1) and succeeding first electrodes are connected to the third lines 430. Thus, the light emitting diodes (LED1~LEDn+1) are connected in series.

The light emitting diodes that are connected in series may be driven by applying power 321 between a first electrode of a first light emitting diode (LED1) and a second electrode of a last light emitting diode (LEDn+1).

Figure 7:
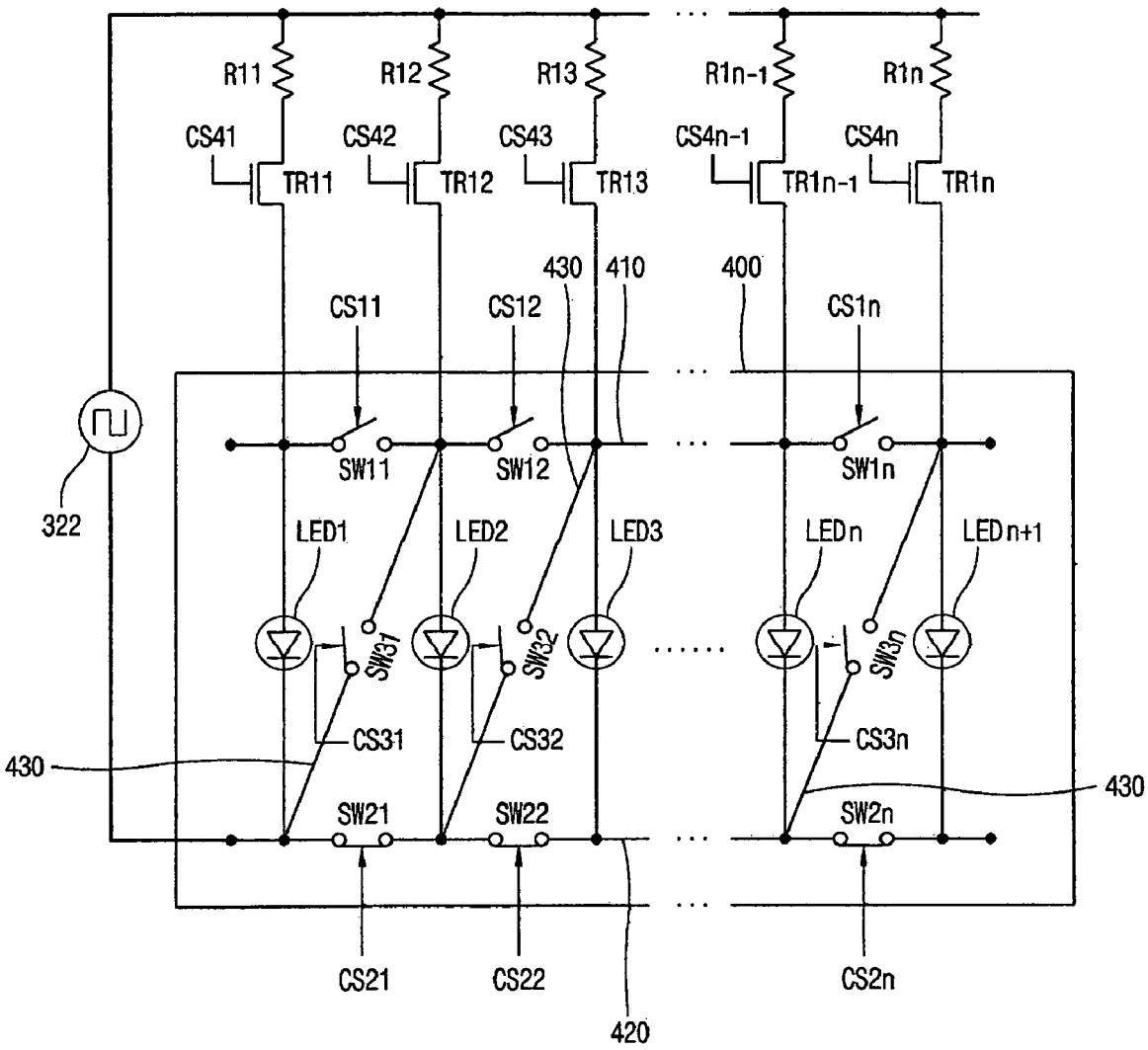
FIG. 7 is an exemplary view of a second embodiment of light emitting diodes connected in parallel according to turn-ON and turn-OFF of first to third selection switches, in FIG. 5.

FIG. 7 is an exemplary view showing a second embodiment of light emitting diodes (LED1~LEDn+1) connected in parallel according to turn-ON and turn-OFF of the first to third selection switches (SW11~SW1*n*, SW21~SW2*n*, SW31~SW3*n*) shown in FIG. 5.

In FIG. 7, the first selection switches (SW11~SW1*n*) are turned OFF so that the first electrodes of the light emitting diodes (LED1~LEDn+1) are not commonly connected to the first common line 410, the second switches (SW21~SW2*n*) are turned ON so that the second electrodes of the light emitting diodes (LED1~LEDn+1) are commonly connected to the second common line 420, and the third switches (SW31~SW3*n*) are turned OFF so that preceding second electrodes of the light emitting diodes (LED1~LEDn+1) and succeeding first electrodes are not connected to the third lines 430. Accordingly, because the second electrodes of the light emitting diodes (LED1~LEDn+1) are commonly connected to the second common line 420, the light emitting diodes (LED1~LEDn+1) are connected in parallel.

The light emitting diodes (LED1~LEDn+1) connected in parallel as the second electrodes are commonly connected may be driven by applying power 322 between the first electrodes of the light emitting diodes (LED1~LEDn+1) and the second common line 420.

Resistances (R11~R1*n*) and transistors (TR11~TR1*n*) may be individually provided between the power 322 and the first electrodes of the light emitting diodes (LED1~LEDn+1). The light emitting diodes (LED1~LEDn+1) connected in parallel may be selectively driven by controlling turn-ON and turn-OFF of the transistors (TR11~TR1*n*) based on a fourth control signal (CS41~CS4*n*) applied from a control unit 330 of FIG. 4.

Figure 8:
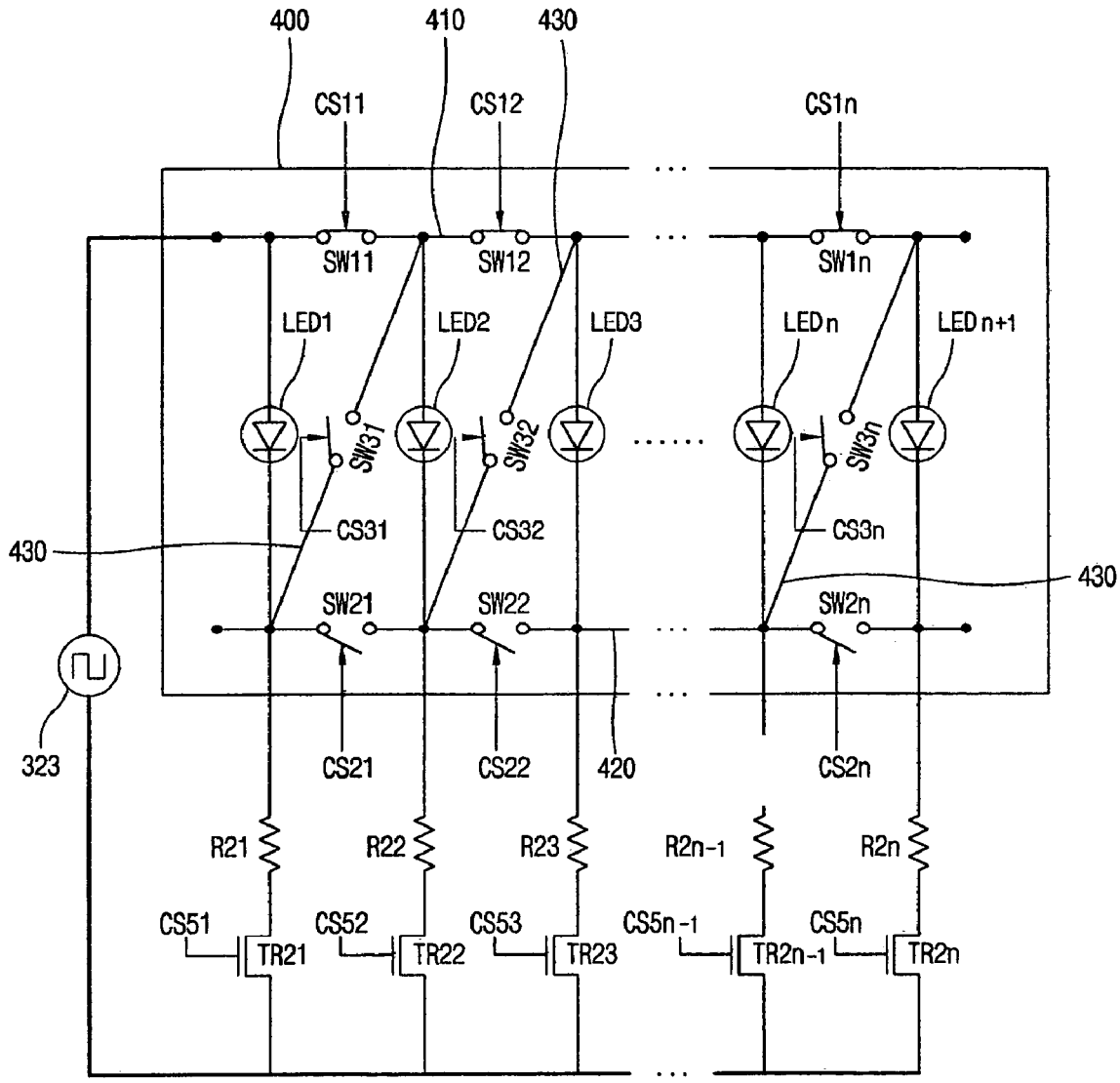
FIG. 8 is an exemplary view showing a third embodiment of light emitting diodes connected in parallel according to turn-ON and turn-OFF of first to third selection switches, in FIG. 5.

FIG. 8 is an exemplary view showing a third embodiment of light emitting diodes (LED1~LEDn+1) connected in parallel according to turn-ON and turn-OFF of the first to third selection switches (SW11~SW1*n*, SW21~SW2*n*, SW31~SW3*n*).

In FIG. 8, the first selection switches (SW11~SW1*n*) are turned ON so that the first electrodes of the light emitting diodes (LED1~LEDn+1) are commonly connected to the first common line 410, the second selection switches (SW21~SW2*n*) are turned OFF so that the second electrodes of the light emitting diodes (LED1~LEDn+1) are not commonly connected to the second common line 420, and the third selection switches (SW31~SW3*n*) are turned OFF so that preceding second electrodes of the light emitting diodes (LED1~LEDn+1) and succeeding first electrodes are not connected to the third lines 430. Accordingly, because the first electrodes of the light emitting diodes (LED1~LEDn+1) are commonly connected to the first common line 420, the light emitting diodes (LED1~LEDn+1) are connected in parallel.

The light emitting diodes (LED1~LEDn+1) connected in parallel as the first electrodes may be driven by applying power between the first common line 410 and the second electrodes of the light emitting diodes (LED1~LEDn+1).

Resistances (R21~R2*n*) and transistors (TR21~TR2*n*) may be individually provided between the second electrodes of the light emitting diodes (LED1~LEDn+1) and power 323. And, the light emitting diodes (LED1~LEDn+1) connected in parallel may be selectively driven by controlling turn-ON and turn-OFF of the transistors (TR21~TR2*n*) based on a fifth control signal (CS51~CS5*n*) applied from a control unit 330 of FIG. 4.

Figure 9:
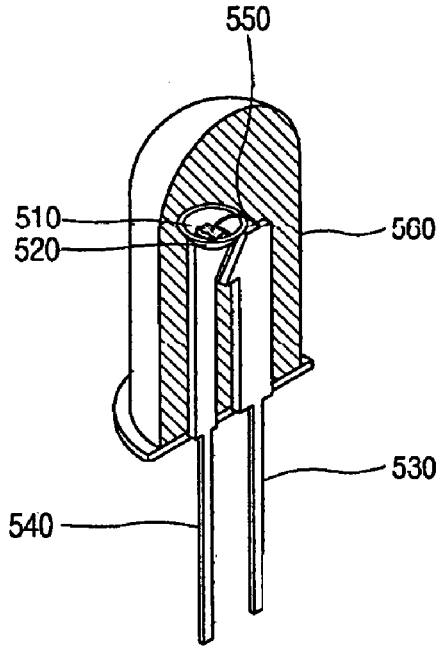
FIG. 9 is an exemplary view illustrating the detailed construction of a light emitting diode used in a back-light apparatus for a liquid crystal display device according to the present invention.

FIG. 9 is an exemplary view showing detailed construction of a light emitting diode used in a back-light apparatus for an LCD device in accordance with the present invention.

In FIG. 9, the light emitting diode includes a light emitting chip 510 generating light; a reflector 520 concentrating and reflecting light generated from the light emitting chip 510 in a desired direction; an anode lead 530 bonded to an anode electrode of the light emitting chip 510 by a gold line 550; a cathode lead 540 bonded to a cathode electrode of the light emitting chip 510 by a gold line 550; and a dome-shaped epoxy lens 560 providing cover to protect the light emitting chip 510, the reflector 520, the gold line 550, the anode electrode and the cathode electrode.

The light emitting chip 510 can generate various colors of light such as white light, red light, green light, blue light or other light.

Figure 10:
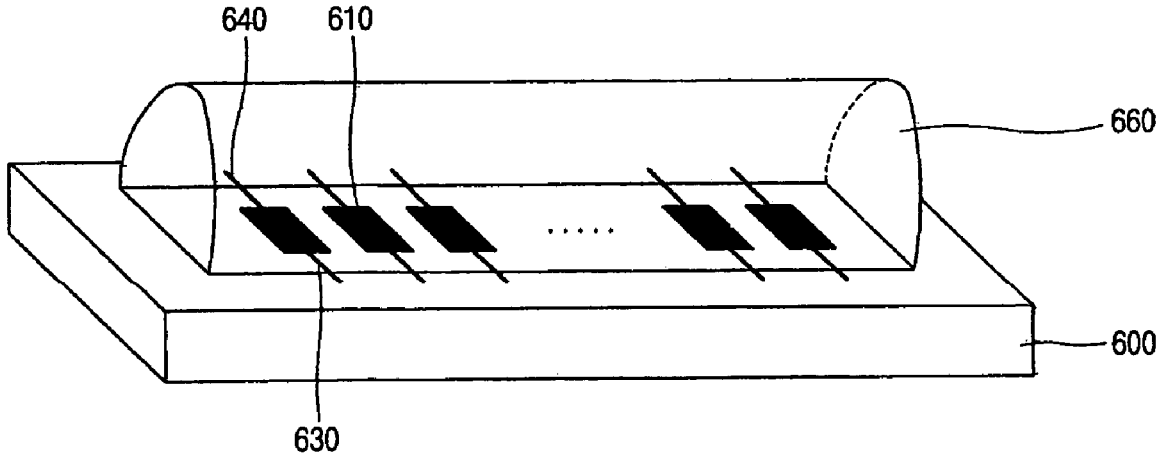
FIG. 10 is an exemplary view illustrating the detailed construction of light emitting diodes used in a back-light apparatus for a liquid crystal display device according to the present invention.

FIG. 10 is an exemplary view showing a detailed construction of light emitting diodes used in a back-light apparatus for an LCD device according to the present invention.

In FIG. 10, the light emitting diodes include a plurality of light emitting chips 610 mounted on a substrate 600 in an array and separated from each other at regular intervals; anode lines 630 electrically connected to anode electrodes of the light emitting chips, respectively; cathode lines 640 electrically connected to cathode electrodes of the light emitting chips, respectively; and at least one optical lens 660 protecting the plurality of light emitting chips mounted on the substrate 600.

The light emitting chips 610 may generate various colors of light including white light, red light, green light or blue light.

Additionally, the light emitting chips 610 may generate different colors of light according to use, or are divided into a certain number of groups, each group generating a different color of light.

The anode lines 630 may be commonly connected to one common line, and the cathode lines 640 may be commonly connected to one common line.

One optical lens 660 may be provided to correspond to a plurality of light emitting chips 610, or a plurality of optical lenses 660 may be individually provided for a plurality of light emitting chips 610.

Additionally, if the light emitting chips 610 are divided into a particular certain number of groups, one optical lens 660 may be provided to correspond to each group.

A shape or a material of the optical lens 660 may be varied according to a desired optical or mechanical characteristic.

If one optical lens 660 is provided to correspond to the plurality of light emitting chips 610 or if one optical lens 660 is provided to correspond to each group of the light emitting chips 610 that have been divided into a particular number of groups, light generated from the light emitting chips 610 can be used with improved efficiency.

The back-light apparatus for an LCD device according to the present invention may be used as a substitute for a cold cathode fluorescence lamp which cannot meet environmental regulations because of its harmfulness to the human body. The backlight apparatus of the present invention can be effectively used to supply light to not only an LCD device but also a flat panel display device.

In order to improve transmittance and a color reappearing rate, the back-light apparatus for the LCD device according to the present invention may time-divide one frame of an image into first to third sub-frames and sequentially supply red, green and blue light according to the first to third sub-frames. Accordingly, the back-light apparatus can be effectively used in an LCD adopting a time-division method and displaying an image.

In the back-light apparatus for an LCD device according to the present invention, a plurality of light emitting diodes are arranged in a light emitting unit for supplying light to an LCD panel in an array, and electrical connection between the light emitting diodes can be selectively made.

Accordingly, the back-light apparatus for an LCD device according to the present invention can be commonly used in various models of an LCD device without having to individually fabricate a light emitting unit. In addition, the back-light apparatus can address the various driving conditions of an LCD device to improve productivity.

As for the back-light apparatus for the LCD device according to the present invention, light generated from light emitting chips can be used with improved efficiency by applying one optical lens that corresponds to a plurality of light emitting chips arranged in an array.

It will be apparent to those skilled in the art that various modifications and variation can be made in the present invention without departing from the spirit or scope of the invention. Thus it is intended that the present invention cover the modifications and variations of this invention provided they come within the scope of the appended claims and their equivalents.

What is claimed is:

1. A back-light apparatus for an LCD device comprising: a light emitting unit including a plurality of light emitting diodes arranged on a substrate, wherein the plurality of light emitting diodes are connected in parallel and in series based upon a position of a plurality of selection switches; a power unit to supply power to the light emitting diodes of the light emitting unit; and a control unit to control connections between the light emitting diodes of the light emitting unit, wherein the light emitting unit comprises: a first common line mounted on the substrate such that first electrodes of the light emitting diodes are commonly connected to the first common line; a second common line mounted on the substrate such that second electrodes of the light emitting diodes are commonly connected to the second common line; a plurality of third lines arranged between preceding second electrodes of the light emitting diodes and succeeding first electrodes; first selection switches and second selection switches for connecting or disconnecting the first and second electrodes connected to the first common line and the second common line in parallel; and third selection switches for disconnecting or connecting the light emitting diodes in series.

2. The apparatus of claim 1, wherein the first and second selection switches are turned in an off position, the third selection switches are in an on position, and the power unit supplies power between a first electrode of a first light emitting diode and a second electrode of a last light emitting diode to drive the light emitting diodes in series.

3. The apparatus of claim 1, wherein the first selection switches are in an off position, the second selection switches are in an on position, the third selection switches are in an off position, and the power unit supplies power between the first electrodes of the light emitting diodes and the second common line to drive the light emitting diodes in parallel.

4. The apparatus of claim 3, wherein the first electrodes of the light emitting diodes selectively receive power from the power unit by transistors in an ON or OFF position and controlled by the control unit.

5. The apparatus of claim 3, wherein the first electrodes of the light emitting diodes selectively receive power from the power unit passed through a resistance and transistors turned in an ON or OFF position and controlled by the control unit.

6. The apparatus of claim 1, wherein the first selection switches are in an on position, the second selection switches are in an off position, the third selection switches are in an off position, and the power unit supplies power between the first common line and the second electrodes of the light emitting diodes to drive the light emitting diodes in parallel.

7. The apparatus of claim 6, wherein transistors in an on or off position are individually controlled by the control unit between the second electrodes of the light emitting diodes and the power unit.

8. The apparatus of claim 6, wherein resistances and transistors provided between the second electrodes of the light emitting diodes and the power unit are individually controlled by the control unit.

9. The apparatus of claim 1, wherein the light emitting diode comprises: a light emitting chip for generating light; a reflector for concentrating and reflecting the light generated from the light emitting chip in a desired direction; an anode lead bonded to an anode electrode of the light emitting chip; a cathode lead bonded to a cathode electrode of the light emitting chip; and an epoxy lens covering the light emitting chip, the reflector, the anode electrode and the cathode electrode.

10. The apparatus of claim 1 The apparatus of claim 2, wherein the plurality of light emitting diodes comprise: a plurality of light emitting chips arranged on a substrate in an array; anode lines electrically connected to anode electrodes of the light emitting chips; cathode lines electrically connected to cathode electrodes of the light emitting chips; and at least one optical lens covering the plurality of light emitting chips on the substrate.

11. The apparatus of claim 10, wherein the light emitting chips are divided into a predetermined number of groups, wherein each predetermined group generates a different color of light.

12. The apparatus of claim 11, wherein the at least one optical lens is provided to correspond to each predetermined number of groups of the light emitting chips.

13. The apparatus of claim 10, wherein the at least one optical lens individually corresponds to the light emitting chips.

14. A back-light apparatus of a liquid crystal display device comprising:

a plurality of light emitting diodes attached on a substrate;

a first common line mounted on the substrate to commonly connect first electrodes of the light emitting diodes;

a second common line mounted on the substrate to commonly connect second electrodes of the light emitting diodes;

a plurality of third lines connected to preceding second electrodes of the light emitting diodes and succeeding first electrodes of the light emitting diodes;

first selection switches and second selection switches disconnecting or connecting the first common line and the second common line so that the light emitting diodes are connected in parallel;

third selection switches for disconnecting or connecting the third lines so that the light emitting diodes are connected in series;

a power unit to supply power to the light emitting diodes; and a control unit to control the first, second and third selection switches for the light emitting diodes.

15. The apparatus of claim 14, wherein when a first portion of the light emitting diodes is connected in parallel, a second portion is connected in series based on an on or off position of the first to third selection switches.

16. The apparatus of claim 14, wherein when the first and second selection switches are in an off position, the third selection switches are in an on position, and the power unit supplies power between a first electrode of a first light emitting diode and a second electrode of a last light emitting diode to drive the light emitting diodes in series.

17. The apparatus of claim 14, wherein when the first selection switches are in an off position, the second selection switches are in an on position, the third selection switches are in an off position, and the power unit supplies power between the first electrodes of the light emitting diodes and the second common line to drive the light emitting diodes in parallel.

18. The apparatus of claim 17, wherein when the first electrodes of the light emitting diodes selectively receive power from the power unit by transistors in an ON or OFF position, and controlled by the control unit.

19. The apparatus of claim 17, wherein the first electrodes of the light emitting diodes selectively receive power from the power unit passed through a resistance and transistors in an ON or OFF position and controlled by the control unit.

20. The apparatus of claim 14, wherein the first selection switches are in an on position, the second selection switches are in an off position, the third selection switches are in an off position, and the power unit supplies power between the first common line and the second electrodes of the light emitting diodes to drive the light emitting diodes in parallel.

21. The apparatus of claim 20, wherein transistors in an on or off position are individually controlled by the control unit provided between the second electrodes of the light emitting diodes and the power unit.

22. The apparatus of claim 21, wherein resistances and transistors provided between the second electrodes of the light emitting diodes and the power unit are individually controlled by the control unit.

23. The apparatus of claim 14, wherein the light emitting diode comprises:

a light emitting chip for generating light;

a reflector for concentrating and reflecting the light generated from the light emitting chip in a desired direction;

an anode lead bonded to an anode electrode of the light emitting chip;

a cathode lead bonded to a cathode electrode of the light emitting chip; and an epoxy lens covering the light emitting chip, the reflector, the anode electrode and the cathode electrode.

24. The apparatus of claim 14, wherein the plurality of light emitting diodes comprise:

a plurality of light emitting chips arranged on a substrate in an array;

anode lines electrically connected to anode electrodes of the light emitting chips;

cathode lines electrically connected to cathode electrodes of the light emitting chips; and at least one optical lens covering the plurality of light emitting chips on the substrate.

25. The apparatus of claim 24, wherein the light emitting chips generate different colors of light.

26. The apparatus of claim 24, wherein the light emitting chips are divided into a predetermined number of groups wherein each group generates a different color of light.

27. The apparatus of claim 24, wherein at the least one optical lens individually corresponds to the light emitting chips.

28. The apparatus of claim 27, wherein the at least one optical lens corresponds to each predetermined number of groups of the light emitting chips.

* * * * *